United States Patent [19]

Miller

[11] 4,019,638

[45] Apr. 26, 1977

[54] HANGING JAR CAP WITH STORING UNIT

[76] Inventor: Matt Miller, 1118 Bay Oaks, Houston, Tex. 77008

[22] Filed: Aug. 14, 1975

[21] Appl. No.: 604,717

[52] U.S. Cl. ..... 211/74; 215/100 R; 248/317; 211/113

[51] Int. Cl.[2] ..... A47F 5/08

[58] Field of Search ..... 211/94, 13, 123, 113, 211/115, 49, 162, 74, 75, 76, 79, 85; 248/307, 311, 312, 340, 339, 359, 360, 304, 214, 215; 312/330 R; 215/100 R

[56] References Cited

UNITED STATES PATENTS

| | | | |
|---|---|---|---|
| 1,587,793 | 6/1926 | Nelson | 211/74 |
| 1,981,510 | 11/1934 | Jones | 312/330 |
| 2,512,502 | 6/1950 | Paschell | 211/95 X |
| 2,523,682 | 9/1950 | Corwin | 211/113 X |
| 2,557,801 | 6/1951 | Shapiro | 211/113 X |
| 2,606,666 | 8/1952 | Gray | 211/113 |
| 2,787,435 | 4/1957 | Shields | 248/340 X |
| 3,119,541 | 1/1964 | Lynn | 215/100 A |
| 3,300,075 | 1/1967 | Dahl | 215/100 R |

*Primary Examiner*—Roy D. Frazier
*Assistant Examiner*—Terrell P. Lewis
*Attorney, Agent, or Firm*—Paul L. DeVerter, II

[57] ABSTRACT

An improved storing unit for the storage of different sizes of nuts, bolts, nails and the like within separated jars, each jar having a screw cap thereupon and which includes an upward loop for being removably suspended from a hook, the hooks being arranged in rows on the underside of sliding bars that slide into an underside grooves of a shelf or board so that a large number of the jars are thus suspended therefrom so to provide a heat storage for the various small items.

5 Claims, 12 Drawing Figures

Fig. 1
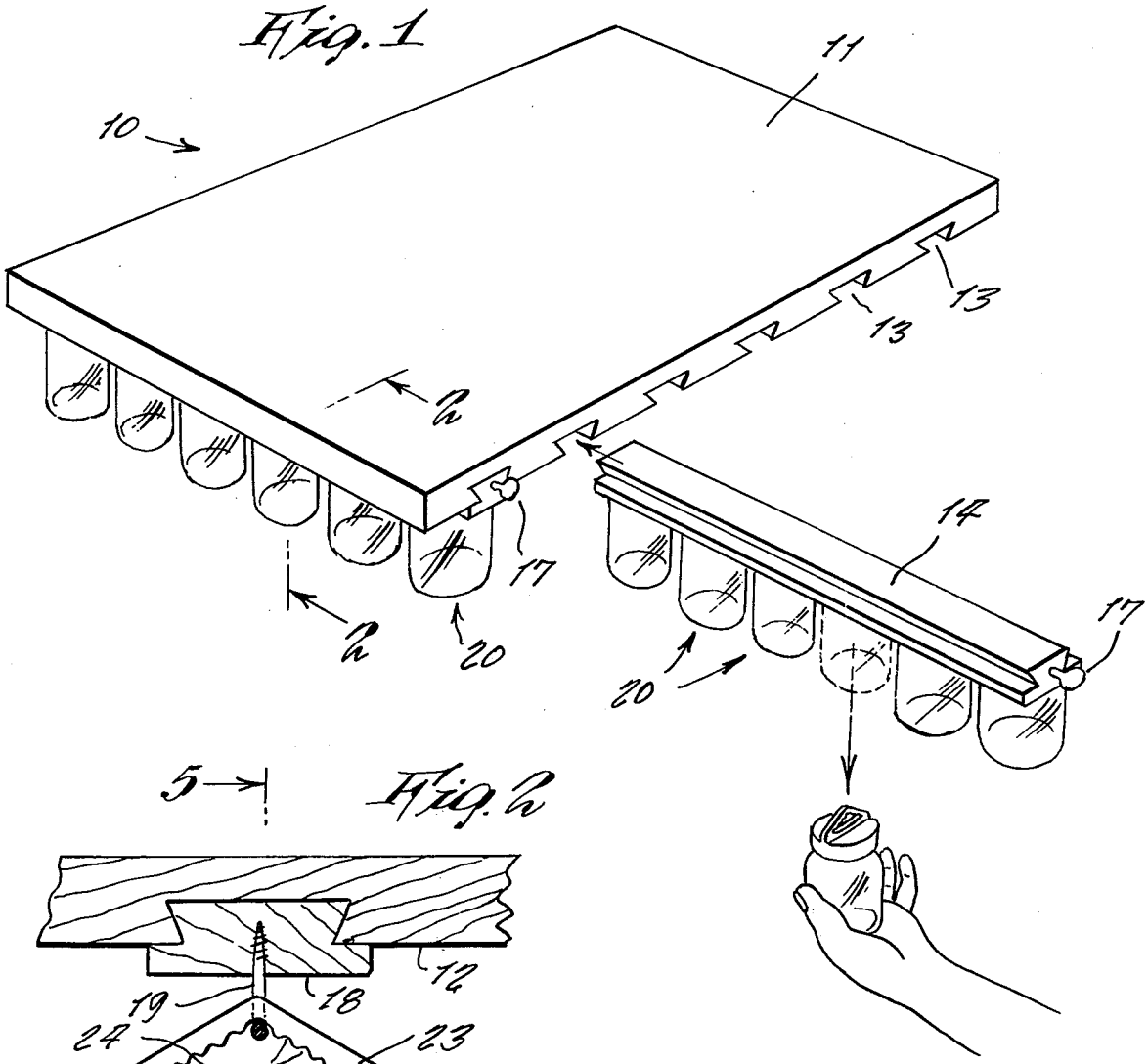
5 Fig. 2
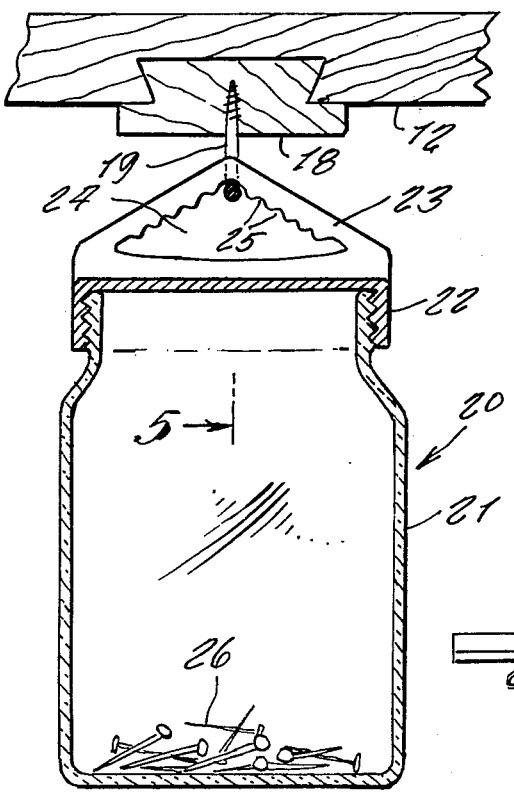
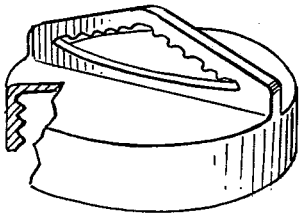
Fig. 3
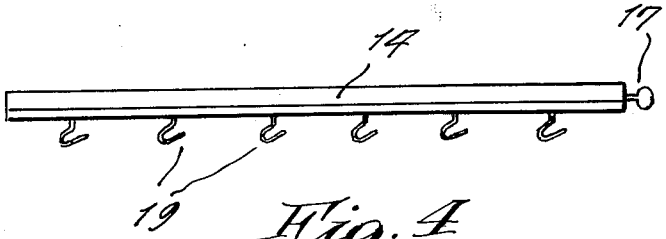
Fig. 4

HANGING JAR CAP WITH STORING UNIT

This invention relates generally to storage units.

A principle object of the present invention is to provide an improved storage unit in which numerous small items such as different sizes of nuts, bolts, nails or the like may be stored in a set of jars that are suspended on an underside of a shelf or the like so to be out of the way when not needed.

Another object of the present invention is to provide an improved storing unit in which the jars are suspended from hooks arranged in rows on the underside of sliding bars that slide within grooves on the underside of the shelf so that quick and easy access is provided to any one of the jars as needed.

Still another object of the present invention is to provide an improved storing unit which thus leaves the upper side of the shelves for other uses while the entire underside of the shelf supports jars in series of rows.

Still another purpose of the present invention is to provide an improved storing unit which alternately can comprise an upright frame containing the jars suspended from hooks, and wherein the frame is slidable upwardly or outwardly of a cabinet, the frame having a pull handle upon its front side.

Still another object of the present invention is to provide an improved storing unit wherein accordingly the sliding frames can be incorporated in a kitchen counter cabinet, a pantry cabinet, a workship bench or the like.

Other objects are to provide an improved storage unit which is simple in design, inexpensive to manufacture, rugged in construction, easy to use and efficient in operation.

These and other objects will be readily evident upon a study of the following specification and the accompanying drawings wherein:

FIG. 1 is a top perspective view of a board shelf and showing the present invention incorporated therewith.

FIG. 2 is an enlarged cross-sectional view taken along line 2—2 of FIG. 1.

FIG. 3 is a perspective view of the jar cap shown partly is in cross-section.

FIG. 4 is a side view of the sliding bar.

Figure 6:
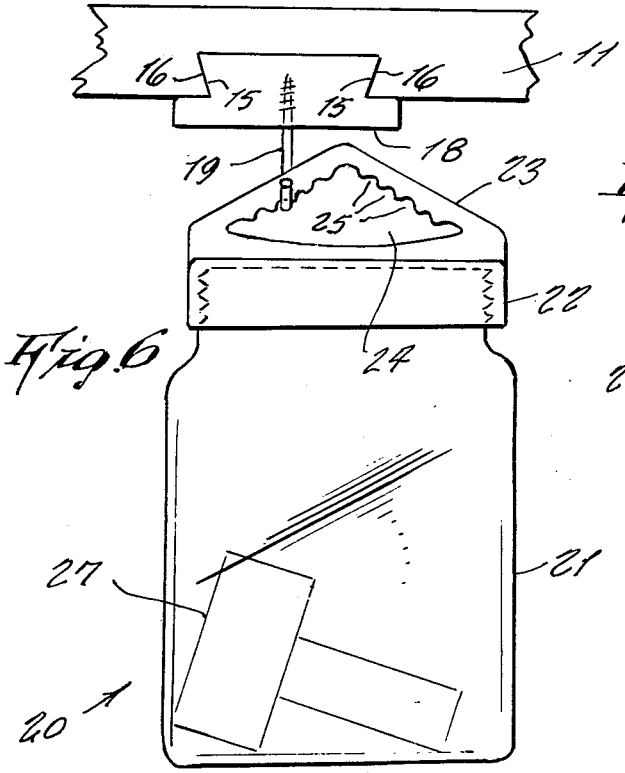
FIG. 6 is a view similar to FIG. 2 and showing a sideward displacement of the jar on a hook so to maintain the jar in a vertical position while an offset weighted object is contained inside the jar.
Figure 5:
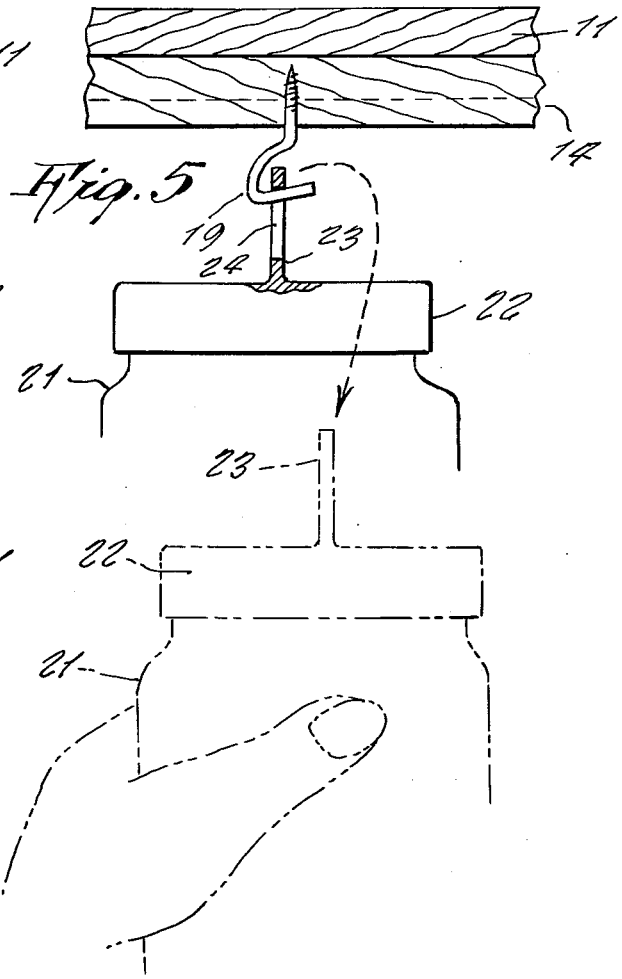
FIG. 5 is a cross-sectional view taken along line 5—5 of FIG. 2.

Referring now to the drawings in detail, an more particularly FIGS. 1–6 thereof at this time, the reference numeral 10 represents an improved storing unit according to the present invention wherein the same includes a horizontal board or shelf 11 which may be installed along side a wall within a home, office or factory, the upperside of the shelf 11 being adaptable for placement of various items thereupon, and the underside 12 of the shelf having rows of longitudinal grooves 13 within each of which a sliding bar 14 is slidable inwardly and outwardly so that it can be completely removed therefrom or completely slided inwardly there into as shown in FIG. 1. Each of the grooves 13 has downwardly converging side walls 15 in order to support therebetween the opening sidewalls 16 of the sliding bar 14. A forward end of the sliding bar is provided with an eye screw 17 so to form a pull handle in order to slide the bar outward from under the shelf.

On the underside 18 of the sliding bar there are a row of downward extending hooks 19, each hook supporting a jar unit 20.

Each jar unit 20 includes a clear glass jar 21 so to permit looking inside therethrough when hunting for a particular item contained therewithin. A cap 22 is screw threaded upon the upper end of the jar, the cap also including an upward extending loop 23 which includes a generally triangular shaped loop opening 24, the loop opening comprising a series of notches 25. The cap is preferably made of a molded hard plastic so that they are rigid. Each of the jars can contain different sizes of various small items such as the nails 26 shown in FIG. 2. Alternately as shown in FIG. 6, the jars can contain various items such as object 27 which is heavier on one end then at its other end. Accordingly in order that the jar is suspended in a vertical position and prevented from being tilted by the offset weighted object 27, the hook 19 can be engaged within one of the notches 25 located more directly over the heavy end of the object 27 instead of the hook engaging the central notch such as shown in FIG. 2.

Figure 7:
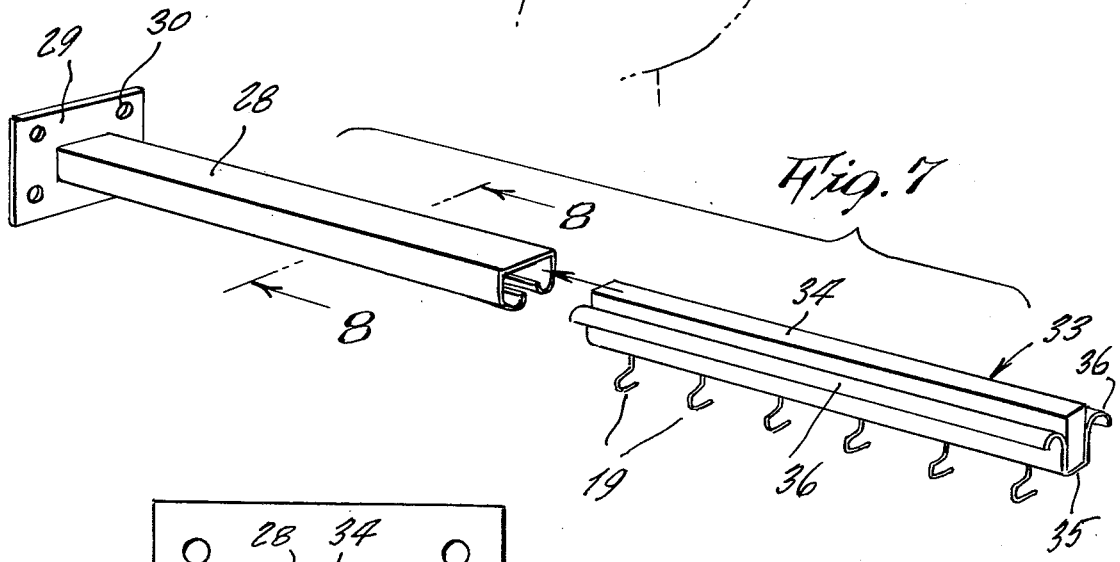
FIG. 7 is a perspective view of a modified design of the invention which employs a "uniflex" channel iron.
Figure 8:
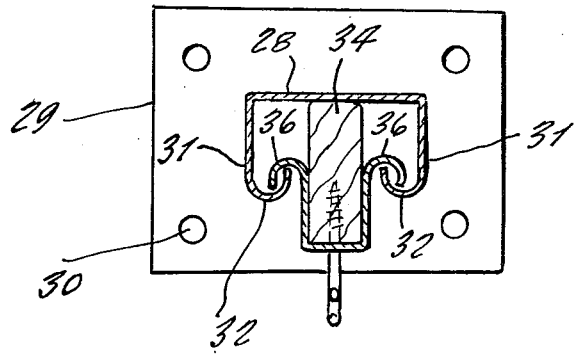
FIG. 8 is an enlarged cross-sectional view taken along line 8—8 of FIG. 7.
Figure 9:
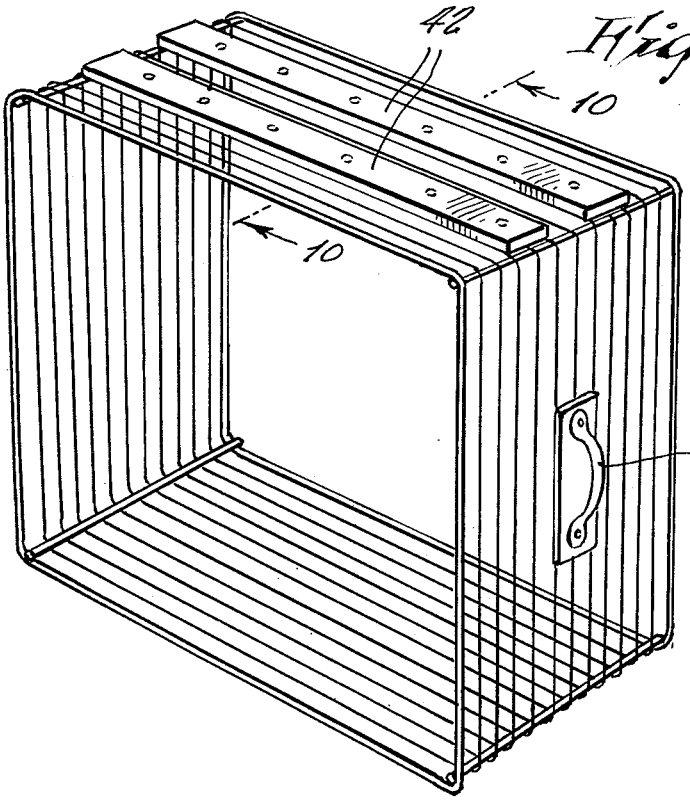
FIG. 9 is a perspective view of another modified design of the invention wherein the same includes an upright frame that is slidable into a storage cabinet.
Figure 10:
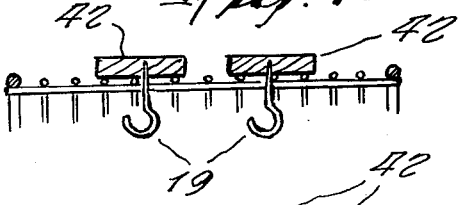
FIG. 10 is an enlarged cross-sectional view taken along line 10—10 of FIG. 9.
Figure 11:
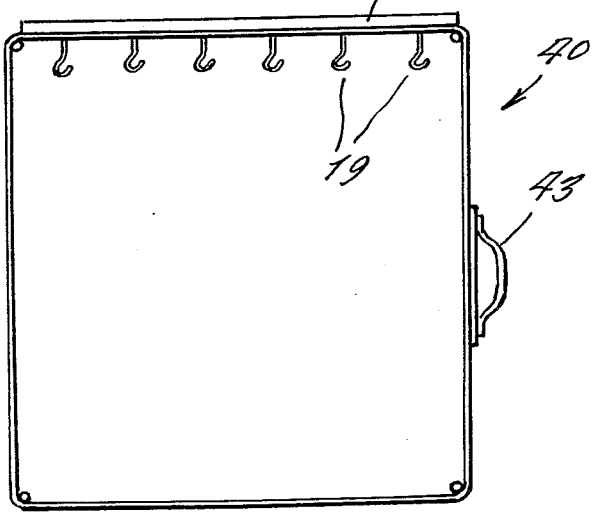
FIG. 11 is a side elevation view of the sliding frame shown in FIG. 9.
Figure 12:
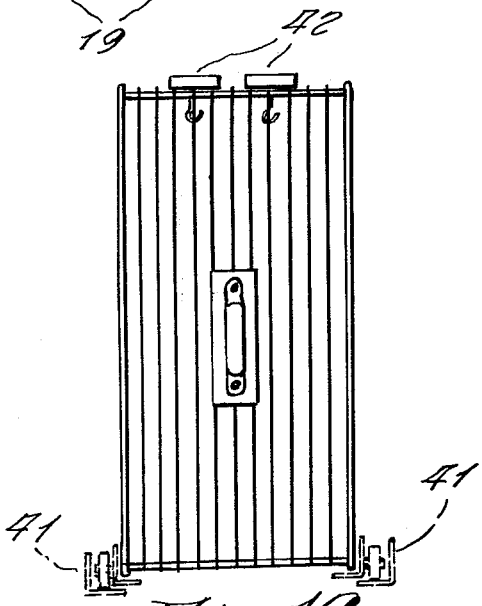
FIG. 12 is a front elevation view thereof shown supported upon suspension rails of the cabinet.

References now made to FIGS. 7 and 8 wherein a modified design of the invention includes a "uniflex" channel iron 28 welded at one end to a vertical plate 29 having mounting openings 30 in order to be secured to a vertical wall. The underside of the channel iron 28 includes inwardly and upwardly bent sidewalls 31 so to form two tracks 32 for supporting a sliding bar 33. The sliding bar 33 includes a block 34 made of wood and which has a U-shaped channel secured to its lower side, the U-shaped channel 35 having outwardly rounded side edges 36 for sliding within the tracks 32, as shown in FIG. 8. A series of hooks 19 are secured to the underside of the sliding bar 33, as above described. Thus a modified design of the invention is provided.

References now it made to FIGS. 9–12 wherein a further modified design of the invention comprises a upstanding frame for carriage 40 that is adaptable to slide upon a suspension rails system 41 of a storage cabinet such as a kitchen counter cabinet, a workship cabinet or the like. The carriage 40 is made of stiff metal wire such as is used in manufacture of stove grates and the like and which upon its upper side includes a pair of plates 42 secured thereto, each plate having a row of downwardly extending hooks 19 secured thereto which extend into the interior of the carriage so that the above described jar units can be hooked thereto. A convenient handle 43 is secured to a front side of the carriage so that the same may be pulled in an out of the large cabinet. While the carriage 40 may be made of wood instead of metal wire, the wire construction is suggested for use in kitchen or pantry storage cabinets in order to prevent formations of crevices wherein roaches would live.

Thus several forms of the invention have been provided.

While various changes may be made in the detailed construction, it is understood that such changes will be within the spirit and scope of the present invention as is defined by the appended claims.

What I claim is:

1. In an improved storage unit, the combination of:

a plurality of jars for containing an assortment of various objects, a screw cap on each jar releasably attached to the jar, an open loop extending upwardly from each cap, the loop being generally triangular with the base of the triangle adjacent the cap, a series of notches extending downwardly from the two legs of the open triangular loop, a plurality of hooks depending from the storage unit, each loop arranged to hang from a hook, whereby each cap and jar attached thereto may be suspended from a hook, and the hook engaging the loop between adjacent notches such that each jar may be suspended vertically by sideways displacement of the loop when the weight of objects in the jar is offset.

2. The combination as set forth in claim 1 including slide means interposed between the hooks and the storage unit.

3. The combination as set forth in claim 2, wherein said slide means includes a board shelf having a downwardly converging dove tail grooves on its underside each of which receives a slidable bar having said hooks extending downwardly therefrom.

4. The combination as set forth in claim 2, wherein said means comprises a "uniflex" channel iron.

5. The combination as set forth in claim 2, wherein said means comprises a wire carriage slidable into a cabinet.

* * * * *